US007476157B1

(12) United States Patent
Bertilson

(10) Patent No.: US 7,476,157 B1
(45) Date of Patent: Jan. 13, 2009

(54) CUE BALL POINT OF AIM TRAINING DEVICE AND METHOD OF USE

(76) Inventor: John L. Bertilson, P.O. Box 142501, Anchorage, AK (US) 99514

( * ) Notice: Subject to any disclaimer, the term of this patent is extended or adjusted under 35 U.S.C. 154(b) by 23 days.

(21) Appl. No.: 11/405,057

(22) Filed: Apr. 17, 2006

(51) Int. Cl.
*A63D 15/00* (2006.01)

(52) U.S. Cl. ..... 473/2; 473/1; 473/4; 473/5; 473/17; D21/783; D21/309

(58) Field of Classification Search ..... 473/2, 473/1, 3–5, 14, 10; 273/118 D
See application file for complete search history.

(56) References Cited

U.S. PATENT DOCUMENTS 158,655 A * 1/1875 Wainwright ..... 473/2
735,132 A * 8/1903 McCutche, Jr. ..... 273/119 R
2,000,123 A * 5/1935 Cahill ..... 473/5
2,010,282 A * 8/1935 Wanncmacher ..... 473/2
3,312,470 A * 4/1967 Ames ..... 473/575
3,649,018 A * 3/1972 Beam ..... 273/386
3,724,849 A * 4/1973 Pierce ..... 473/2
D228,079 S * 8/1973 Huffman ..... D21/309
3,947,026 A 3/1976 Scoutten
D246,002 S * 10/1977 Hahne et al. ..... D21/309
4,151,990 A 5/1979 Josenhans
4,268,033 A * 5/1981 Fontaine ..... 473/2
4,337,943 A 7/1982 Stewart
D335,515 S * 5/1993 Caron ..... D21/783
5,401,215 A 3/1995 Pfost
5,833,236 A * 11/1998 Oursler et al. ..... 273/127 R
6,827,651 B1 12/2004 Davis

* cited by examiner

*Primary Examiner*—Mitra Aryanpour

(57) ABSTRACT

A cue ball point of aim training device, comprising a target, a target positioning member, a transverse member, and a support structure provided for aiming a cue ball with respect to a given object ball. The base of the support structure, when positioned on the playing surface, resides to one side of a line bisecting the object ball along the desired direction of travel, and can remain in place during a shot on the object ball. The target, representing where the center of a cue ball needs to be to effectuate a desired trajectory for a given object ball, is positioned by the other components of the device in an opposite direction along the line of intended travel of the object ball. Through repeated use in practice, the cue ball point of aim training device may aid in improving one's skill in playing the game of billiards.

1 Claim, 14 Drawing Sheets

70

CUE BALL POINT OF AIM TRAINING DEVICE AND METHOD OF USE

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

The present embodiment of this invention generally relates to the games of pool and pocket billiards, and specifically to a training device for use in aiming a shot in pool and pocket billiards.

2. Prior Art

In the games of pool and pocket billiards, generally, a cue stick is used to strike and propel a cue ball toward an object ball so that when the object ball is struck by the cue ball, the object ball is directed into a pocket lining the game-playing surface. While it may seem easy in principle to aim a cue ball to collide with an object ball so that the latter is pocketed, in practice it is not always easy. It can require a bit of mental "gymnastics" for a player to achieve the correct aim-point for any shot other than one strait in as the games are played with spheres: a player must recognize that the cue ball can only contact the periphery of the object ball at exactly one radius of the cue ball from the center of the cue ball. Although many novice players can correctly determine where the object ball must be contacted by the cue ball to achieve a desired trajectory, these same players often aim the through the center of the cue ball at the object ball without accounting for the true contact point on the periphery of the cue ball. This method frequently results in a missed shot. Numerous hours of practice are needed for a player to correctly visualize the required contact points on the surfaces of both the cue ball and the object ball, and then use the correct aim-point during a shot to achieve the desired trajectories after a collision.

Inventors have developed aiming devices that attempt to show the correct cue ball aim-point, and to reduce the number of hours of practice required to achieve proficiency in the game. For example, an aiming device 15 in U.S. Pat. No. 4,337,943 to Stewart, 1982 Jul. 6, as depicted in FIG. 1, describes a marking device 16 that will leave a marking substance 17 on the felt of a pool table's playing surface 18 exactly one radius of a cue ball (not shown) away from an object ball 19 when one of the legs 20 of the device 15 is placed next to object ball 19 and device 15 is activated. Device 15 is then removed and a player (not shown) aims the cue ball at mark 17 deposited on playing surface 18 in order to contact object ball 19 at the required location.

Although Stewart's device 15 may show an aim point for a shot in pool or billiards as mark 17 deposited on surface 18, the aim point would be difficult to see from a distance due to its small size and two-dimensional nature. Since the target is a point that the cue ball is intended to roll over, it trains a player to aim with the base of the ball instead of its periphery as referenced by its center. Also, many pool table owners may object to a mark of any kind left by a device, however temporary, being placed on the table's felt.

Another aiming device 21 in U.S. Pat. No. 4,151,990 to Josenhans, 1979 May 1, as depicted in FIG. 2, describes a flat compliant structure with an arrow 22 at one end, an object ball locator 23 in the middle, and an aiming pattern 24 on the other end. Device 21 is placed flat upon playing surface 25 with arrow 22 pointing in the direction of travel desired for object ball 26. Object ball 26 is placed upon the midpoint of device 21 at the object ball locator 23 position. The player then shoots a cue ball 27 at aiming pattern 24 to make contact with object ball 26.

Josenhan's device 21 gives more aiming clues than Stewart's, but it is still only a two-dimensional target placed flat against playing surface 25 making it difficult to see for longer shots. As with all devices with aim-points that are not at the same height as the horizontal contact points of pool balls, a player must mentally make both a vertical and a horizontal aim-point adjustment to realize a desired contact on the periphery of the pool balls. While the flatness of Josenhans' device 21 would allow it to remain in place after a use during game play without interfering much with subsequent shots, its size would make it difficult to place near other balls. In addition, targeting object ball 26 requires the player to first pick up object ball 26 and place it on device 21 before device 21 can be used.

The aiming device in U.S. Pat. No. 5,401,215 to Pfost, 1993 Sep. 2, as depicted in FIG. 3, describes an object ball 28 with a surface coated with an array of colored dots 29, adjacent dots being dissimilarly colored. The player chooses a dot directly opposite the desired trajectory of object ball 28, and then shoots a cue ball (not shown) at the chosen dot (not shown) on object ball 28.

This device only shows where object ball 28 must be struck by a cue ball to achieve a desired trajectory; it does not show where a player must aim the cue ball to make contact with object ball 28 at a desired colored dot 29. A player is expected to intuitively aim for an imaginary spot that is separated from and perpendicular to the contact dot at a distance equal to the radius of the cue ball. Also, certain commonly used venues, like coin operated billiards tables, probably would not be used by a player for practice due to the necessity to pay for the return of object ball 28 each time it has been sunk. In order to practice actual game play, a full set of dotted object balls would be needed, increasing the expense to a player Another aiming device 30, U.S. Pat. No. 3,947,026 to Scoutten, 1975 Apr. 24, as depicted in FIG. 4, describes a representative cue ball 30, cut in half with the flat side up, that is placed immediately adjacent an object ball 31, but opposite the desired trajectory of object ball 31. Device 30 is used as a visual indicator to show a player both the desired point of contact with object ball 31 and the point of aim for a cue ball (not shown.) Once a player has committed the point of aim to memory, aiming device 30 is removed and the player takes the shot.

Once device 30 is removed, however, there is no longer a target indicator at which the player is to aim. The player is required to recall what the sight picture was when the representative cue ball 30 was in place, and try to position an actual cue ball in the same spot next to object ball 31 when making a shot.

An aiming device 32 in U.S. Pat. No. 4,268,033 to Fontaine, 1981 May 19, as depicted in FIG. 5, describes a substantially u-shaped tunnel structure that is placed over object ball 33 so that object ball 33 abuts a specific reference point, object ball cradle 37, within the structure. Device 32 is aimed in the direction of the desired trajectory for object ball 33. A player must shoot cue ball 34 under a "cue ball spotter" 35 above the entrance to device 32 to make contact with object ball 33. Object ball 33 is then ejected through the other end of device 32.

One difficulty with Fontaine's device 32 is that after cue ball 34 makes contact with object ball 33, cue ball 34 can carom off object ball 33 into one of device 32's upright supports 36. A shot that is almost strait-on poses another problem-cue ball 34 may roll into device 32 and collide with object ball cradle 37, which hangs down from within the center of device 32. The form of device 32 is bulky and blocks the view, especially from the player's perspective, of playing surface 38 near object ball 33.

A similar concept to Fontaine's is presented in U.S. Pat. No. 6,827,651 to Davis, 2004 Dec. 7, as depicted in device 49 of FIG. 6, except the spotting and aiming mechanisms are handled by a light unit 43 and a few lasers. A projector body 39 houses these mechanisms above an object ball 40, and is supported by spider-like legs 41 extending to both sides of object ball 40. An alignment stop 42 positions object ball 40, and a light unit 43 projects a flat circle of light on playing surface 44 next to object ball 40 indicating where a player is to aim cue ball 45. A laser 46 in projector body 39 is used to aim device 49 along the desired trajectory for object ball 40; a second laser 47 projects a spot on the midpoint periphery of object ball 40 indicating the desired contact point with cue ball 45; side lasers 48 illuminate reference lines transverse to the longitudinal axis of device 49.

As with Fontaine's device, Davis's device's support legs 41 get in the way of cue ball 45 on certain shots after contact is made with object ball 40. The alignment stop 42 under projector body 39 which positions object ball 40 also gets in the way of cue ball 45 on shots where cue ball 45 would follow object ball 40 after contact. Light unit 47 producing the circle of light used as the aiming indicator for cue ball 45 is two dimensional as projected onto playing surface 44, and difficult to see at a distance. Davis's device 49 is battery operated and requires continual replacement of batteries as they run down. Device 49 would also be considerably more expensive to produce as compared to purely mechanical units due to the complexity of lasers and the light unit 47 in device 49. If a player is practicing with device 49 at a location with other pool tables and players in close proximity, the lasers from device 49 may project targeting lines on the other tables and players. Additionally, certain types of lasers may cause eye damage when inadvertently focused on the eye, limiting the proper use of device 49 to responsible adults.

OBJECTS AND ADVANTAGES

Accordingly, several objects and advantages of the present embodiment of the invention are:

(a) to provide a training device which will enable a billiard player to determine the point of aim for a cue ball with respect to an object ball to achieve a desired trajectory for the object ball;

(b) to provide aiming indicia of adequate size and shape to represent a cue ball in the proper position to contact an object ball to achieve a desired trajectory for the object ball;

(c) to provide an aiming device that is simple in construction and economical to manufacture;

(d) to provide an aiming device that is compact and able to be used at substantially all locations of the playing surface;

(e) to provide an aiming device with a minimum number of structural supports so as to reduce the risk that a cue ball will carom back into the device after the cue ball contacts the object ball;

(f) to provide an aiming device with a minimal amount of structure so as to reduce the amount of the playing surface and balls that would be concealed behind a bulky structure;

(g) to provide an aiming device which neither comes in contact with an object ball nor needs to be removed from the playing surface prior to the immediate sighted shot.

Further objects and advantages will become apparent from a consideration of the ensuing description and drawings.

SUMMARY

In accordance with the present embodiment of the invention, a cue ball point of aim training device comprising a target, a target positioning member, a transverse member, and a support structure, is provided for aiming a cue ball with respect to a given object ball. Through repeated use in practice, the cue ball point of aim training device may aid in improving one's skill in playing the game of billiards.

DRAWINGS

Prior Art Figures

Prior art figures are as follows:

FIG. 1 is a view of the marking guide used to aim a cue ball depicted in U.S. Pat. No. 4,337,943 to Stewart, 1982 Jul. 6.

FIG. 2 is a view of the aiming device depicted in U.S. Pat. No. 4,151,990 to Josenhans, 1979 May 1.

FIG. 3 is a view of the object ball training device depicted in U.S. Pat. No. 5,401,215 to Pfost, 1993 Sep. 2.

FIG. 4 is a view of the training device depicted in U.S. Pat. No. 3,947,026 to Scoutten, 1975 Apr. 24.

FIG. 5 is a view of the cue ball aiming device depicted in U.S. Pat. No. 4,268,033 to Fontaine, 1981 May 19.

FIG. 6 is a view of the training device depicted in U.S. Pat. No. 6,827,651 to Davis, 2004 Dec. 7.

DRAWINGS-PRESENT ART FIGURES

DRAWINGS

Present Art Reference Numerals

Figure 1:
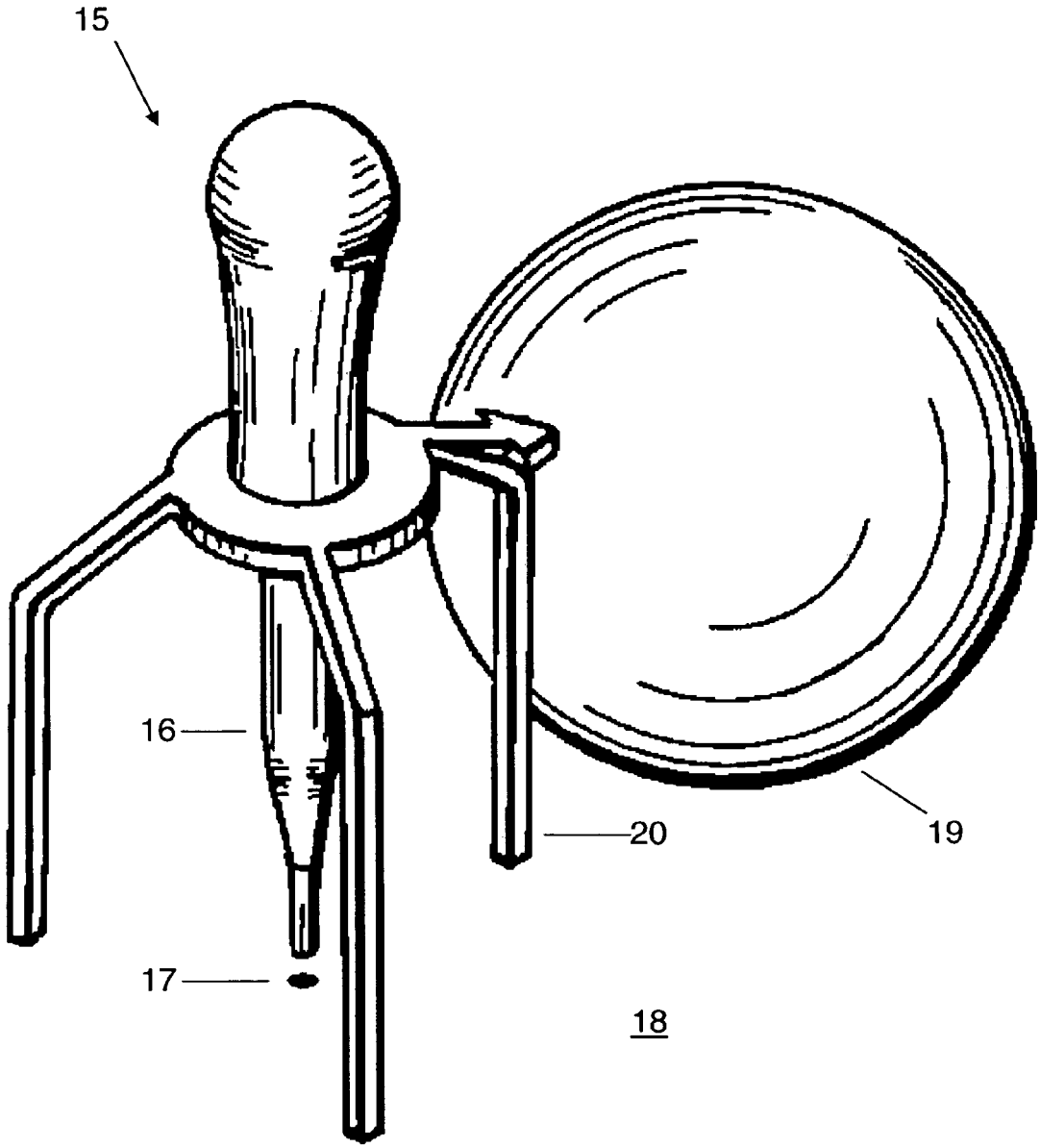
FIG. 1 PRIOR ART
Figure 2:
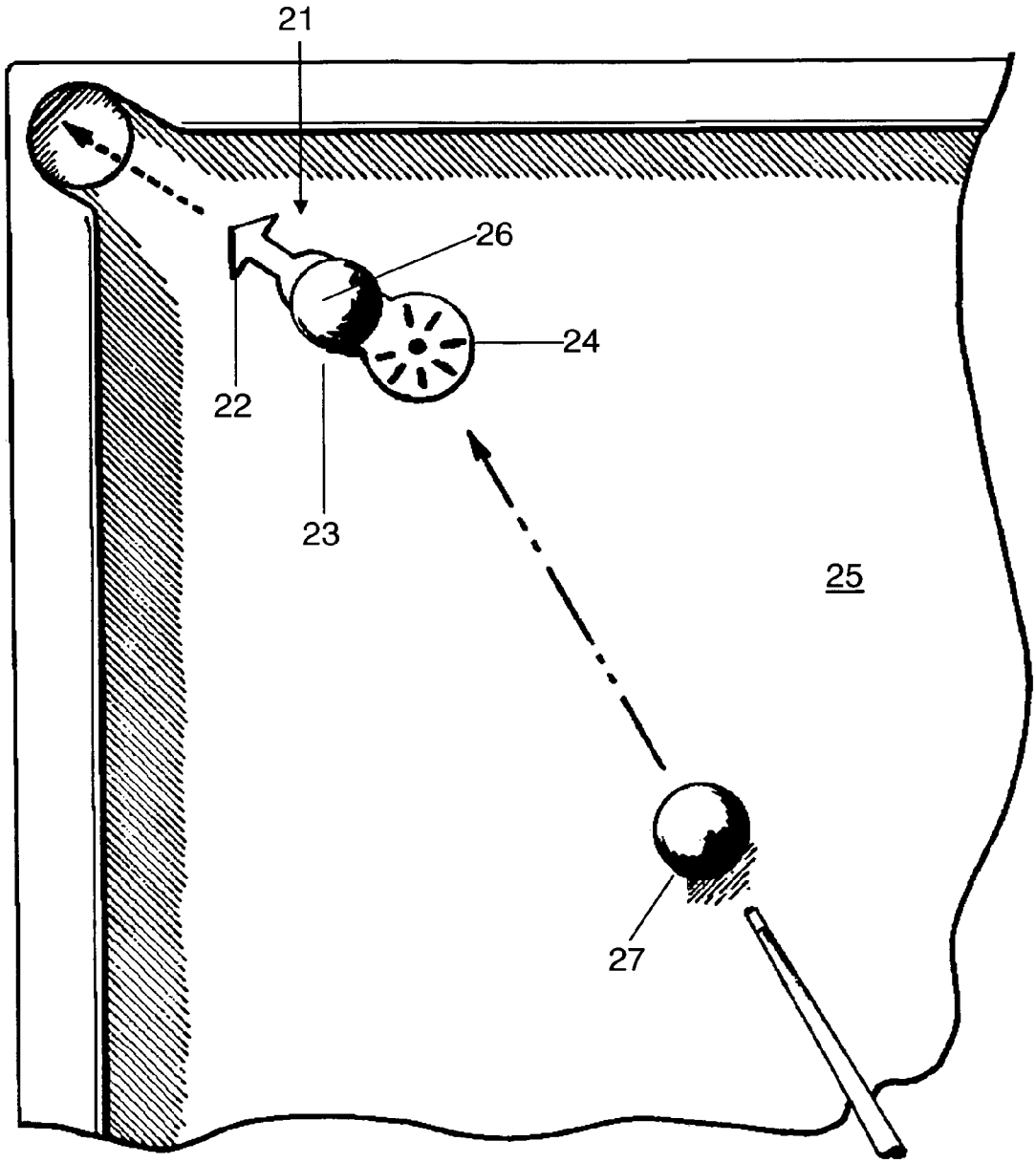
FIG. 2 PRIOR ART
Figure 3:
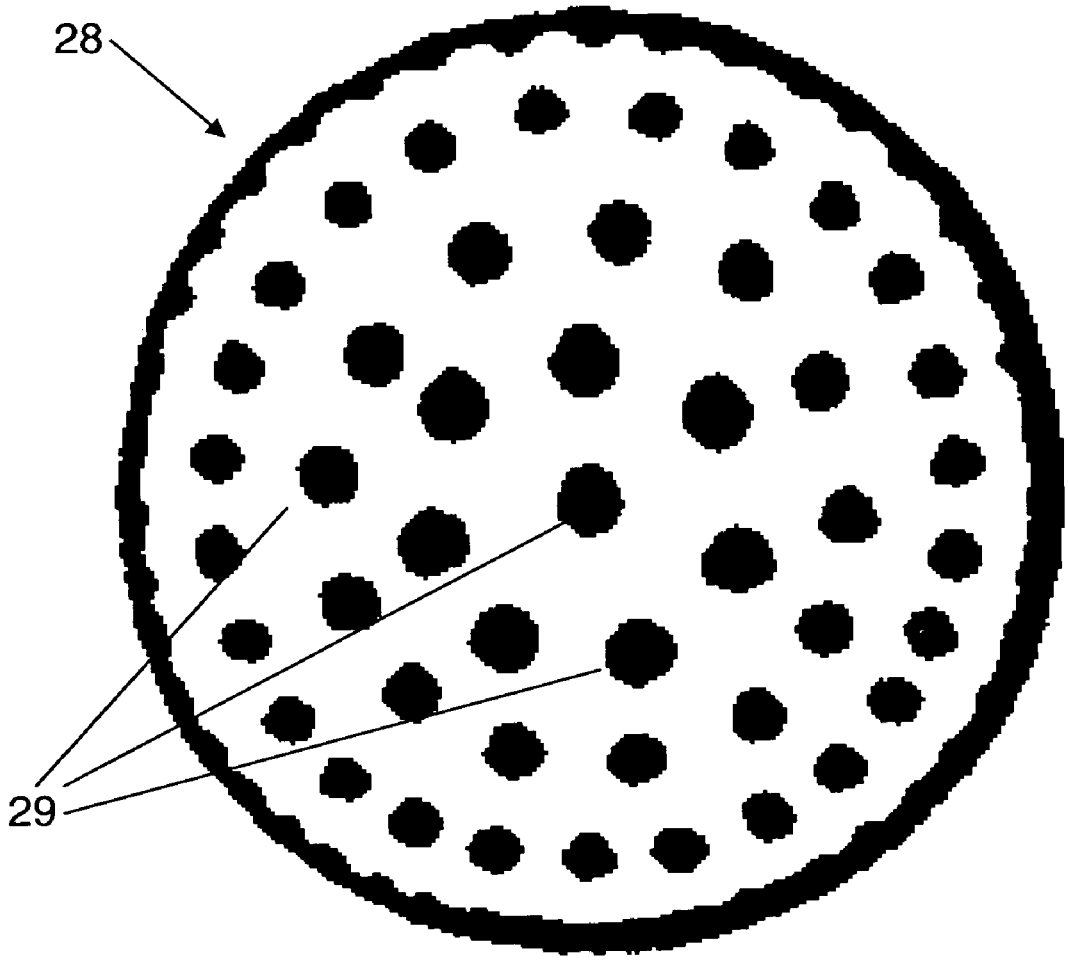
FIG. 3 PRIOR ART
Figure 4:
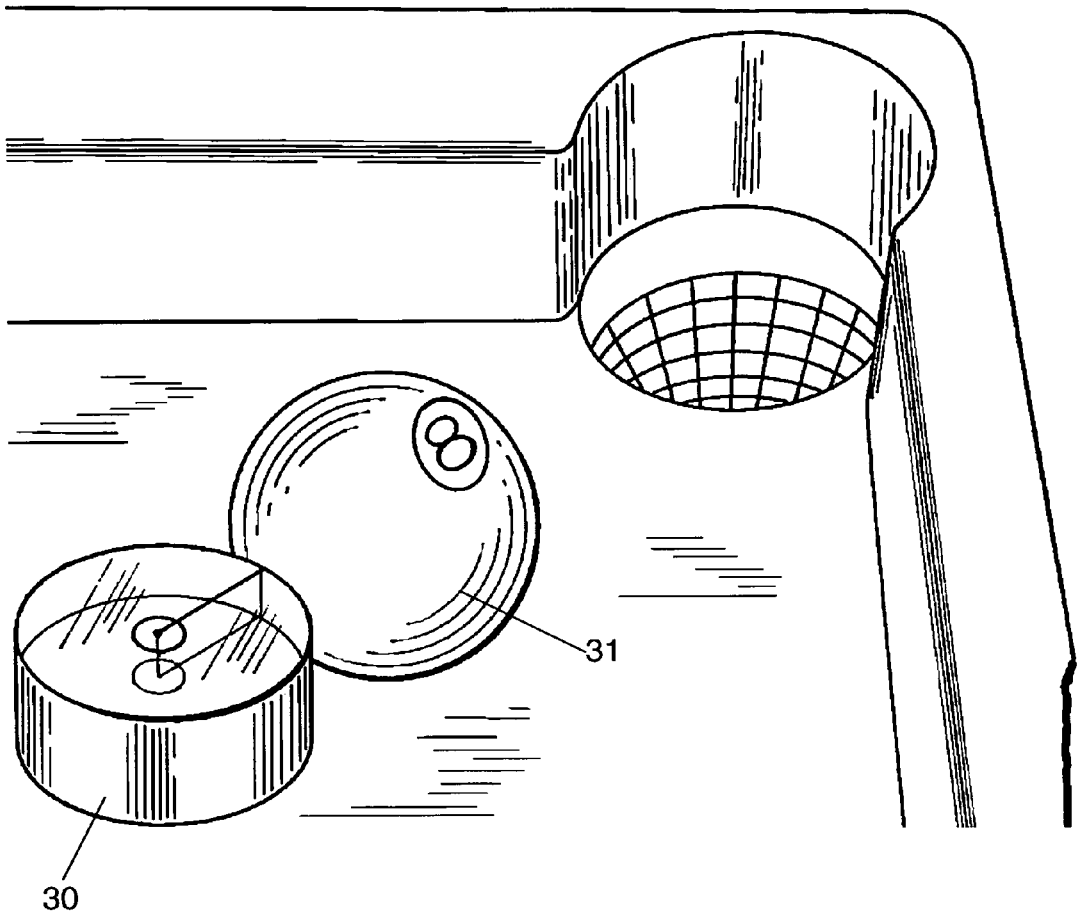
FIG. 4 PRIOR ART
Figure 5:
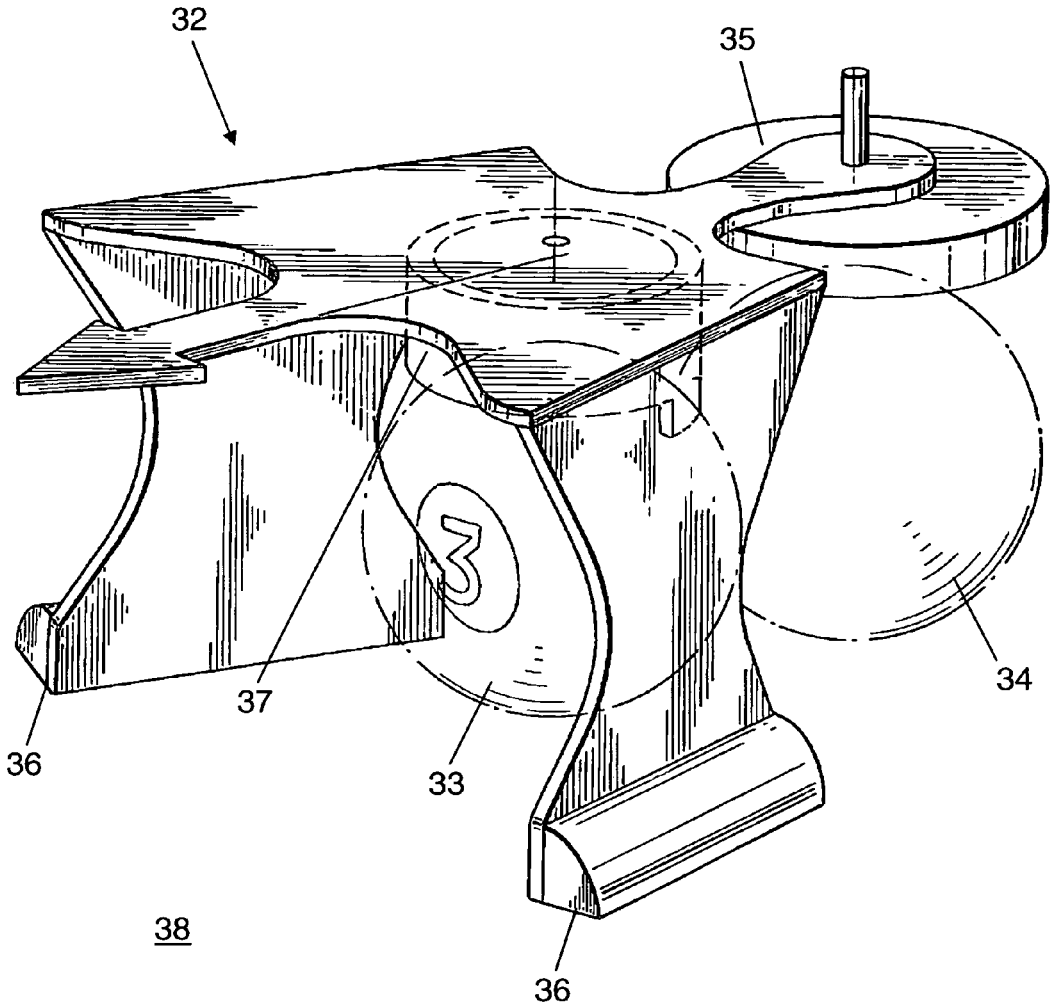
FIG. 5 PRIOR ART
Figure 6:
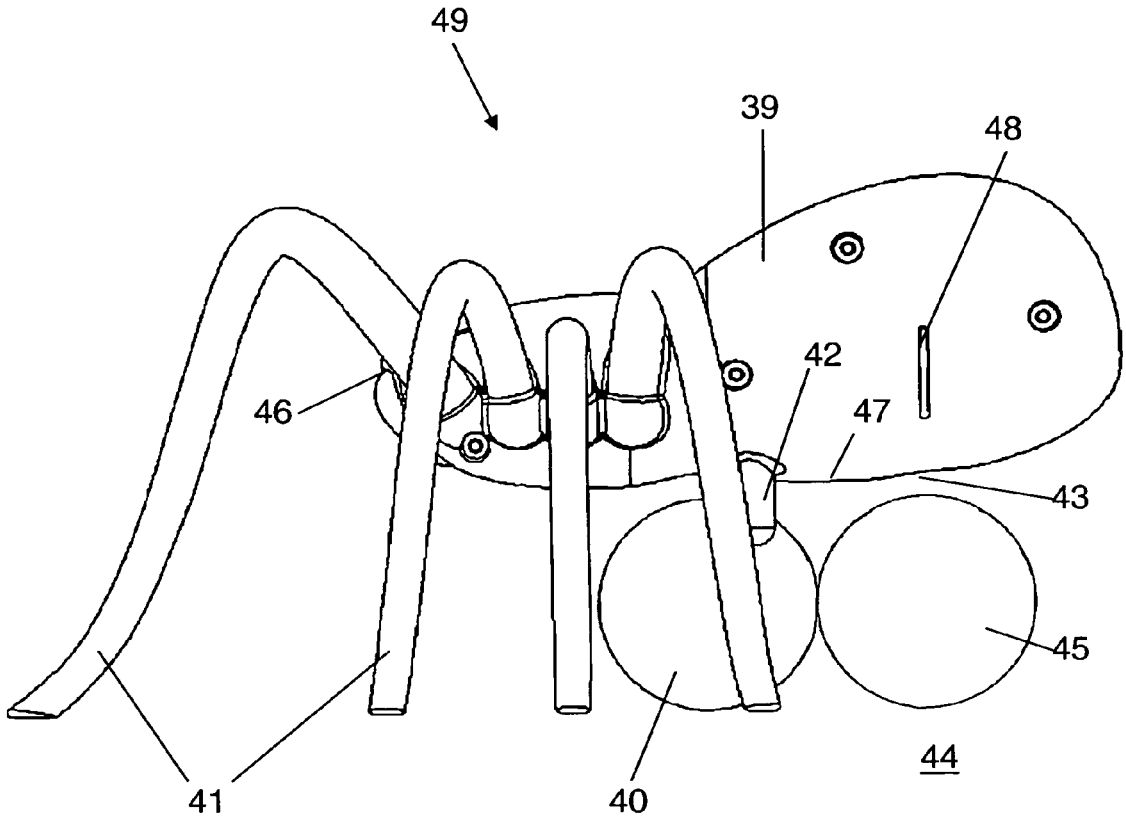
FIG. 6 PRIOR ART

Present art reference numerals are as follows:

50 . . . Training device
51 . . . Base
52 . . . Upright support member
53 . . . Transverse member
54 . . . Target positioner
55 . . . Target
60 . . . Intersection
70 . . . Playing surface
72 . . . Cue ball
74 . . . Object ball
76 . . . Pocket
80 . . . Alternate transverse member
82 . . . Pivot member
84 . . . Vertical hole
A . . . Target positioner distance
B . . . Target distance

DETAILED DESCRIPTION

Figure 7:
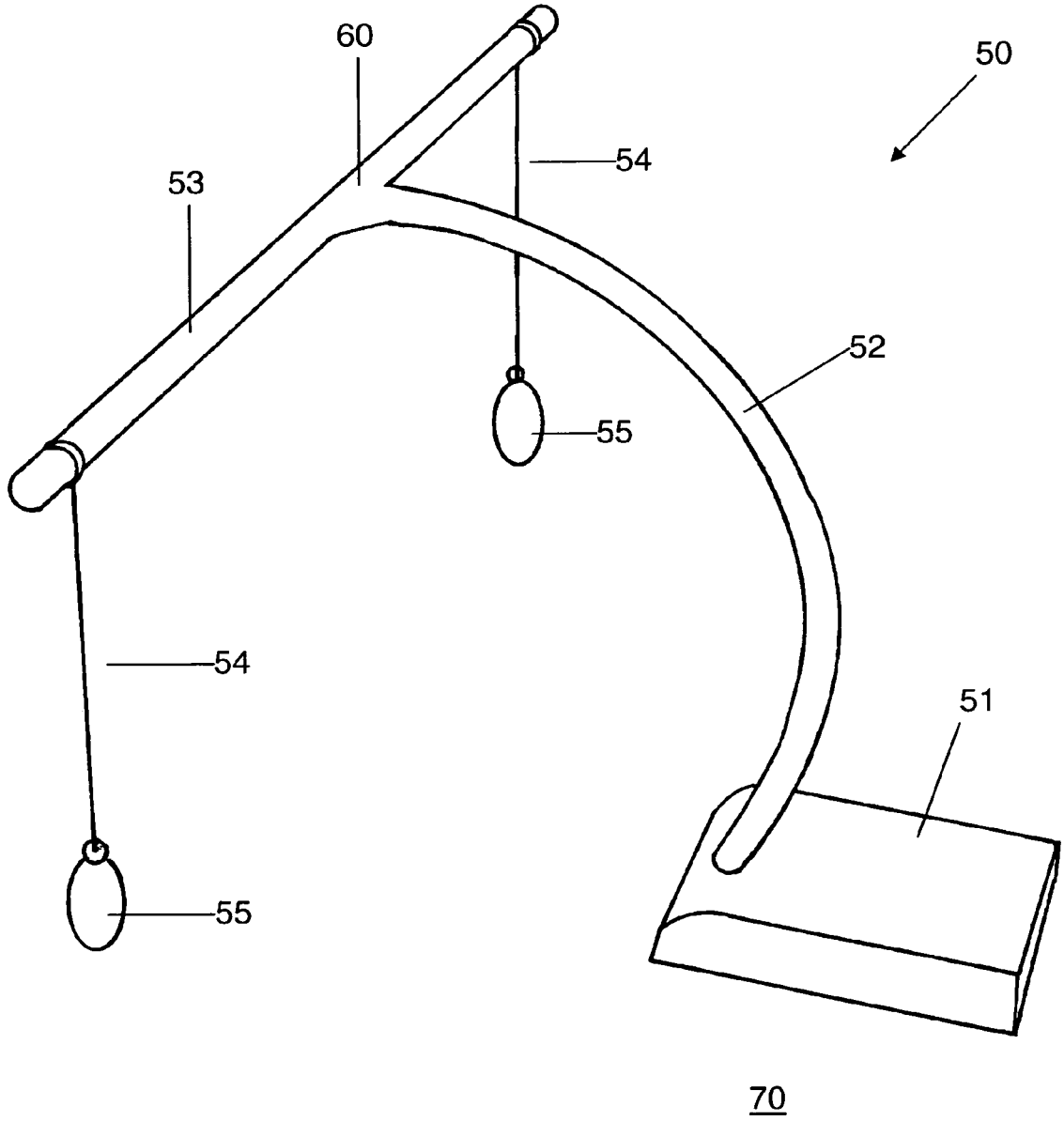
FIG. 7 is a view of the cue ball aiming device from the left rear side.
Figure 8:
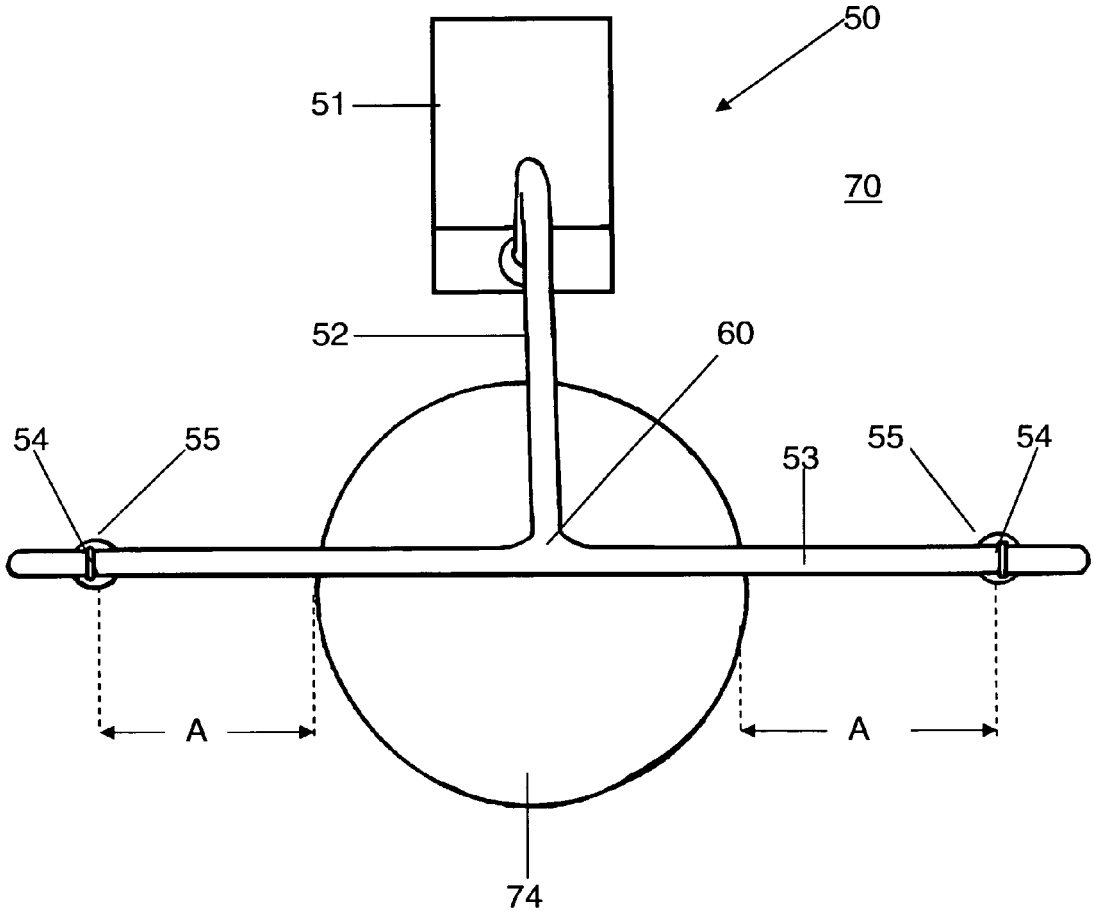
FIG. 8 is a view from overhead of the cue ball aiming device in position next to an object ball.
Figure 9:
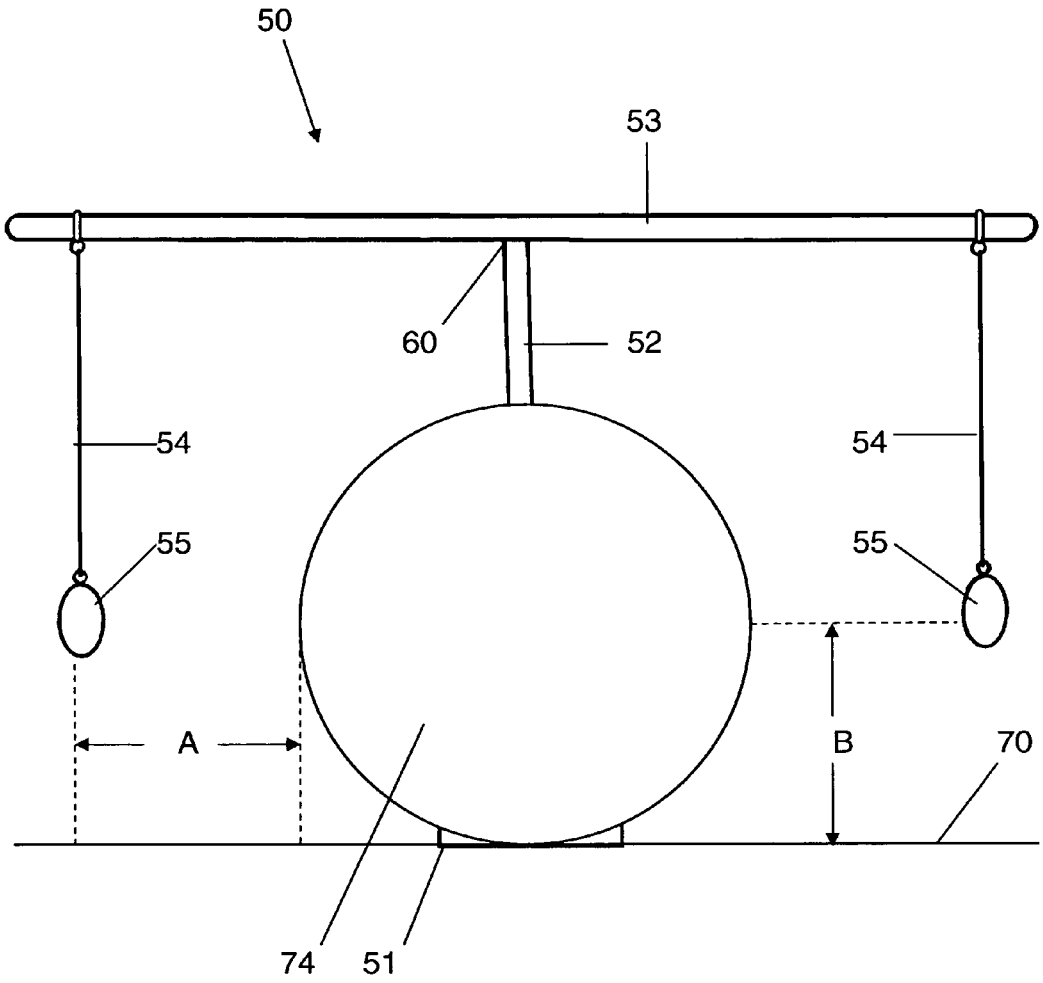
FIG. 9 is a view of the cue ball aiming device from the front.

Preferred Embodiment—FIGS. 7,8, and 9

A preferred embodiment of a cue ball point of aim training device 50 of the present embodiment of the invention is shown representatively in FIG. 7. Cue ball point of aim training device 50 comprises a base 51, an upright support member 52, a transverse member 53, a pair of target positioners 54, and a pair of targets 55, and is adapted to rest on the playing surface of a billiard table 70. The first three elements can be considered part of cue ball point of aim training device 50's support structure. The target positioner 54 and target 55 combination can be considered the cue ball point of aim training device 50's target, as the functions of these two elements can be joined or combined into a single unit to produce substantially the same results.

Referring to FIG. 8, base 51 is provided of just such size, mass, and composition as is necessary to support and position all of the other components of the present embodiment of the invention about and above an object ball 74. It is a feature of the present embodiment of the invention that base 51, when in position on playing surface 70 of a billiard table, resides entirely to one side of a line bisecting object ball 74 along the desired direction of travel for object ball 74. This feature has the advantage of minimizing caroming balls potentially colliding with the present embodiment of the invention after a shot.

Connected to base 51 is a semicircular vertical member, upright support member 52. Referring to both FIGS. 7 and 8, upright support member 52 is contoured to follow the shape of object ball 74 from the base 51 to its general terminus above object ball 74 where it connects with transverse member 53. The main purpose of the contouring of upright support member 52 is to provide a visual reference that the cue ball point of aim training device 50 is in the proper position about object ball 74.

Referring to FIG. 8, transverse member 53 lies substantially horizontally above object ball 74 in relation to playing surface 70, where it is connected substantially perpendicular to upright support member 52 at a midpoint intersection 60. Intersection 60 is used by a player to initially position the cue ball point of aim training device 50 next to object ball 74 by sighting directly down from above intersection 60 and centering intersection 60 over object ball 74.

Referring to both FIGS. 8 and 9, One target positioner 54 is attached to each end of transverse member 53 at target positioner distance A, measured from a line tangent to object ball 74 and perpendicular to playing surface 70 on the same side of object ball 74 that target positioner 54 is to be docked, when object ball 74 is centered at intersection 60. One critical requirement of target positioner distance A is that it equals the radius of a cue ball (not shown) from the set of balls in play. Hence, an appropriate selection for target positioner distance A is contingent upon the radius of the cue ball being used.

Referring to FIG. 9, one target 55 is attached to each target positioner 54. With Target positioner 54 docked at target positioner distance A, it follows that the horizontal center of an attached target 55 will also be at target positioner distance A. The representative center of target 55 is also positioned by target positioner 54, at target distance B over playing surface 70 when the cue ball point of aim training device 50 is in the proper position about object ball 74. A measurement of 1.125 inches for target distance B would be appropriate for billiard ball set sizes of about 2.25 inches in diameter when using a spherical shape for target 55.

While target 55 can be any shape, including conical, elliptical, and ovoidal, a spherical shape is desired, as target 55 is to represent the center of a cue ball when the cue ball is in position to strike an object ball. Target 55 is of a size to be easily seen from across the playing surface, but small enough so that it cannot get pinched between a cue ball and object ball 74 on strait shots. For example, a 0.5-inch diameter for a sphere-shaped target would be appropriate for a billiard ball set using sizes of about 2.25 inches in diameter. The target 55 and target positioner 54 combination is designed to ride up over an approaching cue ball without deflecting the cue ball, and then return to its natural resting state. Each target 55 and target positioner 54 combination are extremely lightweight when compared to the mass of a cue ball that would strike them. A typical cue ball measuring 2.25 inches in diameter weighs approximately 188 grams. The weight of the target 55 and target positioner 54 combination using natural fibers is approximately 0.11 grams-1700 times lighter than the cue ball.

Target positioner 54 can either be a flexible or rigid, but free-swinging member that is used to suspend target 55 from transverse member 53 to a point that represents where the center of a cue ball needs to be in order for the cue ball to contact object ball 74 to effectuate a desired trajectory. Target positioner 54 can be made from natural fibers like cotton or wool thread, or manmade fibers from the plastic or rubber families. Additionally, rigid wire can also be used as long as its attachment point with transverse member 53 is made so that the wire is free-swinging, as with a loop-to-loop arrangement, or a balled end held in a cage. Chain, light in weight and of appropriate size, is also a candidate. Target 55 can be formed from many differing materials as well, however an advantage may be realized if the material chosen were a soft or yielding material, reducing the acceleration off the surface of a cue ball of target 55 when it is struck.

It should be noted that the present embodiment of the invention shows target 55 and target positioner 54 as separate elements; however, these two elements may also be combined as a single unit to accomplish the goal of indicating the aim point for a cue ball with respect to a given object ball. The "single unit" would still have to be flexibly connected to transverse member 53 at target positioner distance A.

As a practical matter, base 51, upright support member 52, and transverse member 53 may be constructed using any metal, wood, or plastic or any other material that would accomplish the goals of this specification. These three components may be connected permanently together, or for ease of transport, made so that they may be disassembled or even folded using hinges, springs, or some compliant material. Additionally, these components may be cast as an integral unit as may be accomplished by injection molding techniques.

OPERATION

Preferred Embodiment—FIGS. 8, 10, 11 and 12

Using the cue ball point of aim training device 50 comprises three simple steps: initial positioning of training device 50, adjusting the line-up of training device 50, and aiming a cue ball at target 55 to make the desired shot. The cue ball point of aim training device 50 will normally remain in place during a shot but can be removed prior to the shot at the player's discretion.

Referring to FIG. 8, the cue ball point of aim training device 50 is placed next to object ball 74 where intersection 60 is directly over the center of object ball 74 so that transverse member 53 parallels a line bisecting object ball 74 along the desired direction of travel for object ball 74. For shots where object ball 74, a cue ball (not shown), and a pocket or other target (not shown) lie substantially on the same line, the placement of base 51 on playing surface 70 can be to either side of object ball 74, as playing conditions allow. However, for any angled shot base 51 should be placed on the same side as the cue ball (not shown) as referenced by a line bisecting object ball 74 along the desired direction of travel for object ball 74. This ensures a reduced risk that the cue ball will careen into base 51 and upright support member 51 after caroming off of object ball 74.

Figure 10:
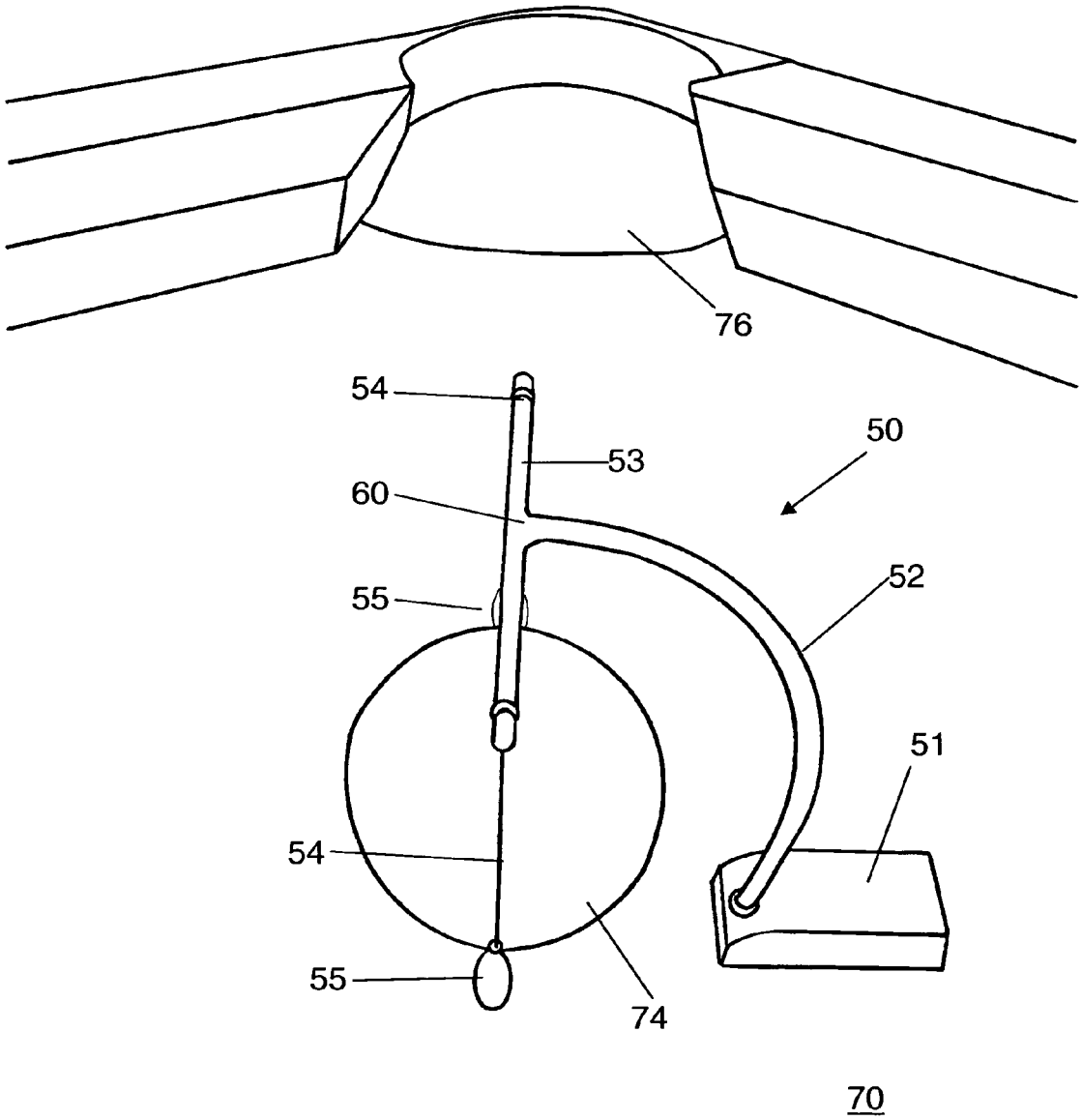
FIG. 10 is a view of the cue ball aiming device next to an object ball, lined up for a shot to a corner pocket.

Referring to FIG. 10, adjusting the line-up of the cue ball point of aim training device 50 is initially accomplished by sighting along transverse member 53 and verifying that it is pointed at pocket 76, the intended target in this representation. Slight aiming adjustments are made by moving base 51. Visually bisecting object ball 74 with transverse member 53, and noting substantially equidistant spacing between object ball 74 and upright support member 52 while adjusting the aim help maintain accuracy.

Figure 11:
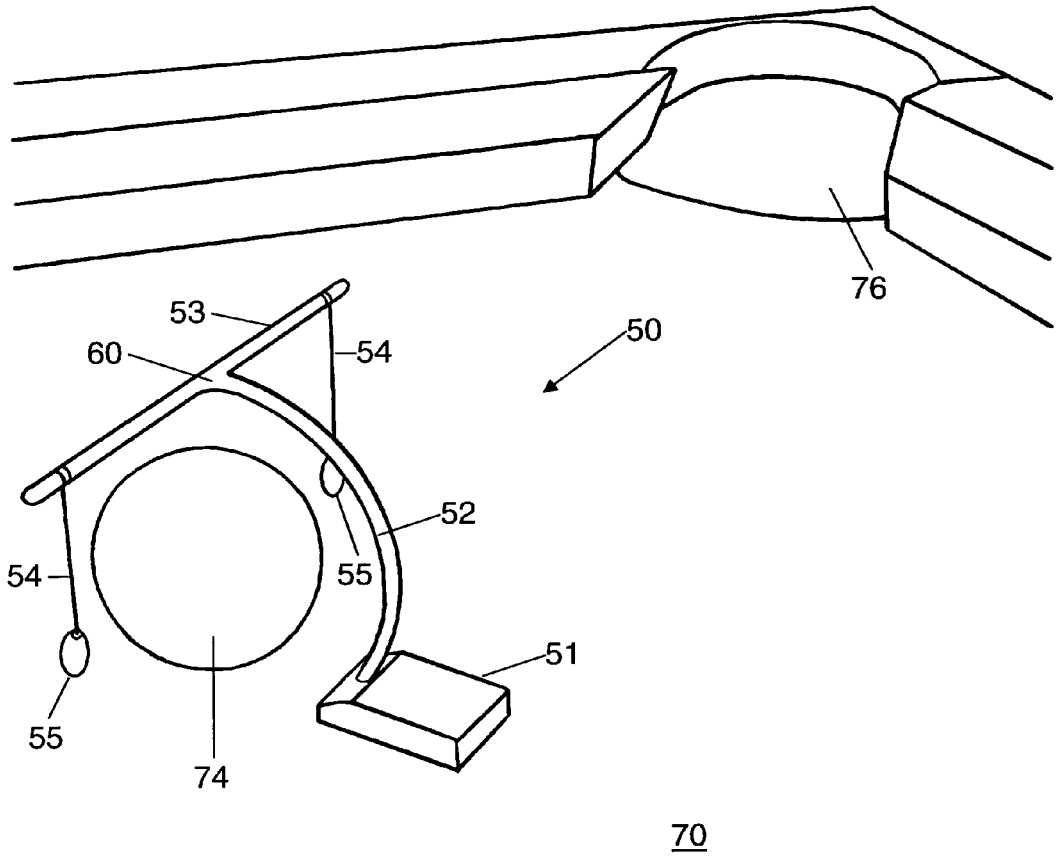
FIG. 11 is a view of the cue ball aiming device from the near side of the table as might be seen when taking a shot using a cue ball.

FIG. 11 is a representation of what a player (not shown) might see when preparing to make a shot at object ball 74, when the cue ball point of aim training device 50 is in position. Transverse member 53 is aimed at pocket 76, and base 51 and a cue ball (not shown) are positioned on the same side as referenced by an imaginary line bisecting object ball 74 along the desired direction of travel for object ball 74. Target 55 is found suspended in an opposite direction along the line of intended travel for object ball 74 at a target positioner distance A. The target 55 closest to pocket 76 is ignored. This target 55 will easily ride up over object ball 74 when it passes through.

Figure 12:
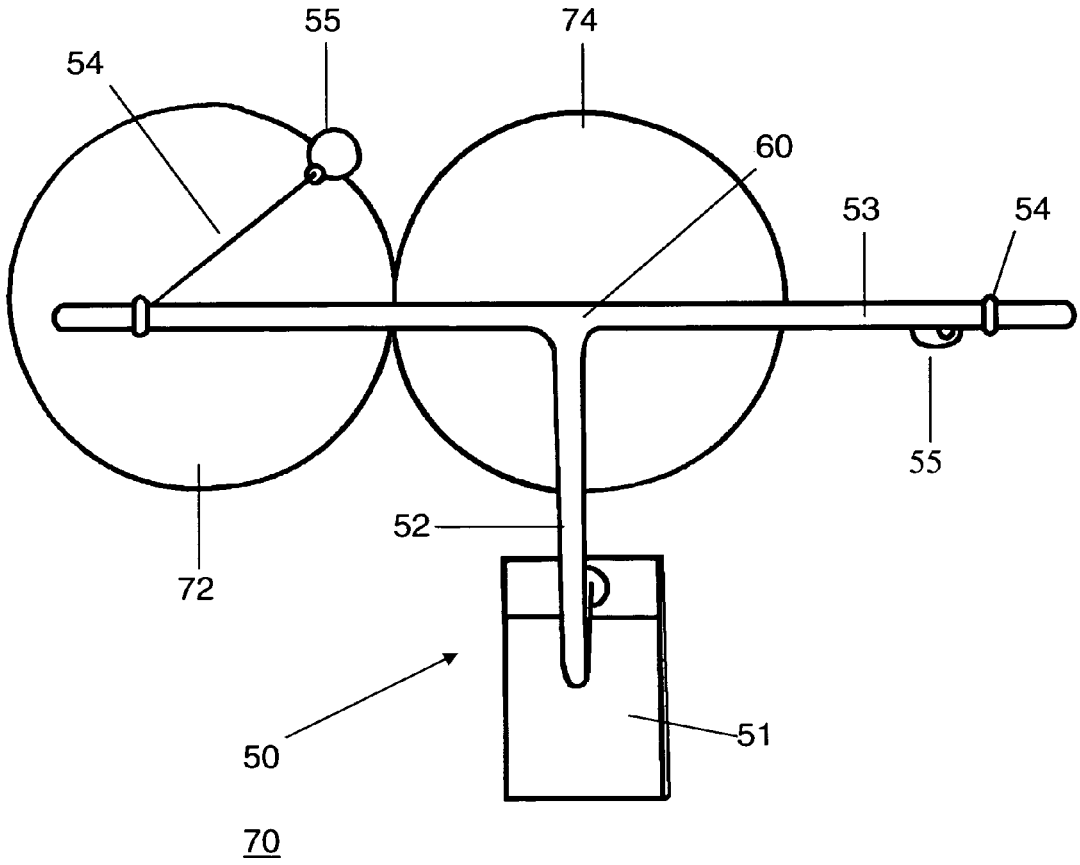
FIG. 12 is a view from overhead of the cue ball aiming device in position with an object ball being struck by a cue ball shot from about 45 degrees to the left rear of the device.

Referring to FIG. 12, a cue ball 72 is shown contacting object ball 74 at a desired point to propel object ball 74 away from cue ball 72 along transverse member 53 toward an intended target (not shown). In this representation, cue ball 72 was aimed and shot directly at target 55 from the lower left quadrant at about a 45-degree angle to transverse member 53. Target 55 and target positioner 54 easily ride up over cue ball 72 as cue ball 72 proceeds to make contact with object ball 74. In the present embodiment of the invention, object ball 74 is then propelled along under transverse member 53, easily pushing aside a second target 55 and target positioner 54 located at the opposite end of transverse member 53 as object ball 74 proceeds toward the intended target.

DESCRIPTION

Figure 13:
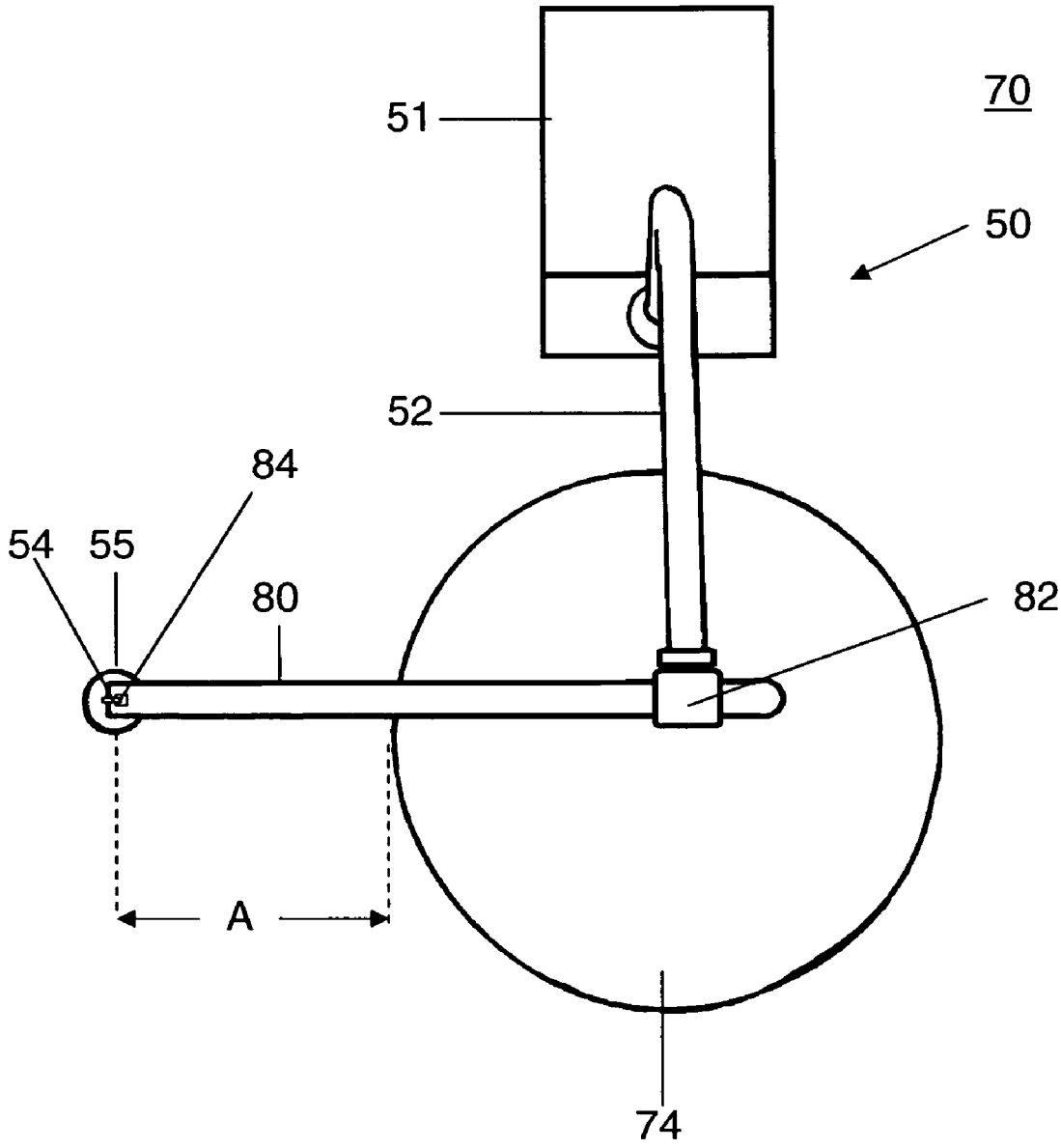
FIG. 13 is a view from overhead of the cue ball aiming device in position about an object ball, as equipped with an alternate pivoting transverse member pivoted to the right, when viewed from behind the base.
Figure 14:
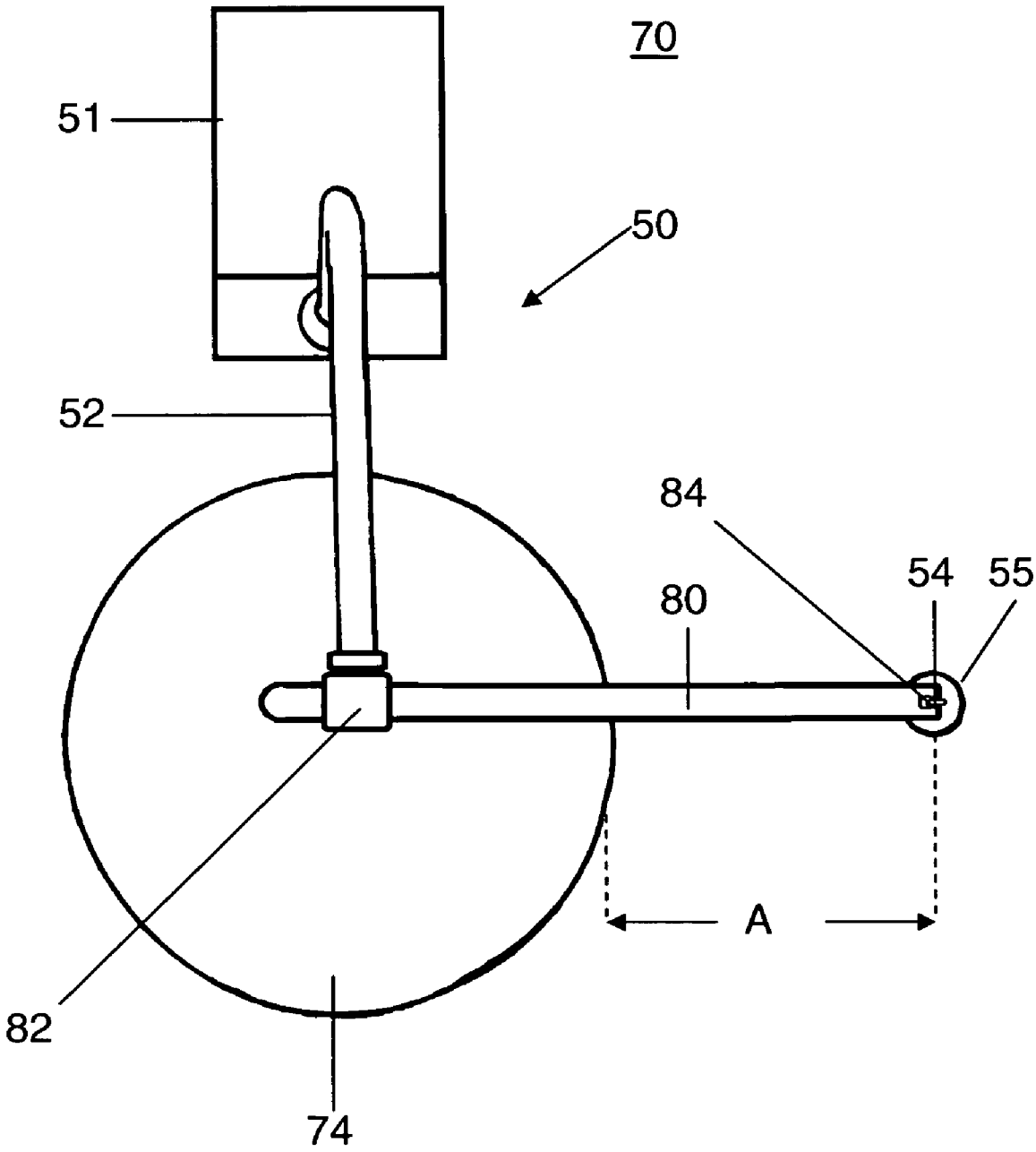
FIG. 14 is a view from overhead of the cue ball aiming device in position about an object ball with the alternate pivoting transverse member pivoted to the left, when viewed from behind the base.

Alternative Embodiment—FIGS. 13 and 14

As shown representatively in FIG. 13, transverse member 80 provides for the same function as transverse member 53 in the present embodiment of the invention, except transverse member 80 has been shortened to carry only one target 55 and target positioner 54 combination. Transverse member 80 is attached to upright support member 52 at pivoting coupler 82. Pivoting coupler 82 can pivot 180 degrees to support transverse member 80 substantially horizontally over playing surface 70 to the right, as viewed from base 51 in FIG. 13, and to the left as referenced in FIG. 14. This alternative embodiment of the invention has the advantage of compactness and requiring only one target 55 and target positioner 54 combination.

OPERATION

Alternative Embodiment—FIGS. 13 and 14

The same three basic steps as required by the present embodiment of the invention to use the cue ball point of aim training device 50 are also employed with the alternative embodiment: initial positioning of training device 50, adjusting the line-up of training device 50, and aiming a cue ball (not shown) at target 55 to make the desired shot. Referring to FIG. 13, the cue ball point of aim training device 50 is placed next to object ball 74 where pivot member 82 is directly over the center of object ball 74 so that alternate transverse member 80 parallels a line bisecting object ball 74 along the desired direction of travel for object ball 74. Since it is desired that base 51 of cue ball point of aim training device 50 be placed on the same side as the cue ball (not shown) as referenced by a line bisecting object ball 74 along the desired direction of travel for object ball 74, transverse member 80 can effectively be pivoted 180 degrees at pivot member 82 to accomplish this. Attaching the target 55 and target positioner 54 combination to transverse member 80 through a horizontal ring (not shown) or a vertical hole 84 at the tip of transverse member 80 will allow the target 55 and target positioner 54 combination to be flipped over to the other side along with transverse member 80 for use.

CONCLUSION, RAMIFICATIONS, AND SCOPE

The reader will see that, according to the present embodiment of the invention, I have provided a cue ball point of aim training device with aiming indicia of adequate size and shape to represent a cue ball in the proper position to contact an object ball to achieve a desired trajectory for the object ball. The device is simple in construction and economical to manufacture, and is compact and able to be used at substantially all locations of the playing surface. The aiming device comprises a minimum number of structural supports and structure so as to reduce the risk that a cue ball will carom back into the device after the cue ball contacts the object ball, and to reduce the amount of the playing surface and balls that would be concealed behind a bulky structure. Also, the aiming device neither comes in contact with an object ball nor needs to be removed from the playing surface prior to the immediate sighted shot.

A natural outgrowth of the present embodiment of the invention is to make the cue ball point of aim training device adjustable to accommodate different sized sets of billiard balls. For example, the transverse member's length can be made to be adjustable using a screw or slide mechanism, and target and target positioner sets may be provided of different sizes. Also, using a sliding ring on the transverse member can be another method of adjusting and attaching the target positioner to the transverse member. Alternatively, the transverse member can have its ends fashioned with a friction slot so that the target positioner can be adjusted along the length of the transverse member as well as up and down. Regardless of the method used to make the cue ball point of aim training device adjustable, it is essential that the horizontal center of that part of the target that represents the center of a cue ball be positioned a distance from the object ball, which equals the radius of a cue ball from the set of balls in play.

Having thus described a present embodiment of the invention, as well as an alternate embodiment of the invention, it will now be appreciated that the objects of the present embodiment of the invention have been fully achieved, and it will be understood by those skilled in the art that many changes in construction and widely differing embodiments and applications of the present embodiment of the invention will suggest themselves without departing from the spirit and scope of the present embodiment of the invention. The disclosures and description herein are intended to be illustrative and are not in any sense limiting of the present embodiment of the invention. Hence the scope of the present embodiment of the invention is defined solely in accordance with the appended claims and their legal equivalents, and not by the examples given. However, the corresponding structures, materials, acts and equivalents of all means or step plus function elements in the claims below are intended to include any structure, material, of acts for performing the functions in combination with other claimed elements as specifically claimed.

I claim:

1. A method of indicating the point of aim for a cue ball with respect to a given object ball, comprising:

a cue ball point of aim device comprising:

a counterbalanced support structure including a substantially vertical post having a first end and a second end;

a base attached to said first end of said substantially vertical post, said base configured for placement on a planar playing surface of a billiard table;

a transverse member attached to said second end of said substantially vertical post, wherein said transverse member having a first end and a second end;

a first target positioner; said first target positioner having a first end and a second end; said first end of said first target positioner being connected to said first end of said transverse member; said second end of said first target positioner including a first target, wherein said first target positioner and said first target are flexibly connected to said transverse member;

a second target positioner; said second target positioner having a first end and a second end; said first end of said second target positioner being connected to said second end of said transverse member; said second end of said second target positioner including a second target, wherein said second target positioner and said second target are flexibly connected to said transverse member;

wherein sufficient mass is provided at said first end of said substantially vertical post to offset said cue ball training device from tipping over when said substantially vertical support is placed on said planar playing surface;

said method comprising the steps of:

providing a billiard table having a planar playing surface;

providing a cue ball and at least one object ball;

positioning said cue ball point of aim device on said playing surface next to the most advantageous side of said object ball as referenced by a line bisecting said object ball along a desired direction of travel for said object ball, wherein said counterbalanced support structure including at least two open pathways, a first of which being large enough to permit said cue ball to strike an object ball resting generally under said counter balanced support structure and a second of which being large enough to permit said object ball to be projected from under said counterbalanced support structure;

adjusting a line-up of said cue ball point of aim device, wherein said transverse member of said cue ball point of aim device is parallel to said line bisecting said object ball along said desired direction of travel for said object ball, said first target positioned on said same side of said object ball to be struck by said cue ball;

aiming said cue ball at said first target prior to making a shot;

shooting said cue ball at said first target to effectuate a desired trajectory for said object ball;

wherein said cue ball aiming device provides a pool player a point of aim for a cue ball to impact a given object ball.

* * * * *